US010385604B2

(12) United States Patent
Muramatsu et al.

(10) Patent No.: US 10,385,604 B2
(45) Date of Patent: Aug. 20, 2019

(54) WINDOW REGULATOR MANUFACTURING METHOD AND TENSION APPLYING METHOD FOR DRIVE WIRE

(71) Applicant: SHIROKI CORPORATION, Fujisawa-shi, Kanagawa (JP)

(72) Inventors: Atsushi Muramatsu, Fujisawa (JP); Kenji Yamamoto, Fujisawa (JP); Kimihiro Kinoshita, Fujisawa (JP); Yoshiki Sugita, Fujisawa (JP); Kenichi Suzuki, Fujisawa (JP); Toru Ikoma, Fujisawa (JP)

(73) Assignee: SHIROKI CORPORATION, Fujisawa-Shi, Kanagawa (JP)

( * ) Notice: Subject to any disclaimer, the term of this patent is extended or adjusted under 35 U.S.C. 154(b) by 190 days.

(21) Appl. No.: 15/531,998

(22) PCT Filed: Apr. 13, 2016

(86) PCT No.: PCT/JP2016/061887
§ 371 (c)(1),
(2) Date: May 31, 2017

(87) PCT Pub. No.: WO2016/167274
PCT Pub. Date: Oct. 20, 2016

(65) Prior Publication Data

US 2017/0314316 A1 Nov. 2, 2017

(30) Foreign Application Priority Data

Apr. 14, 2015 (JP) ..... 2015-082437

(51) Int. Cl.
*E05F 15/689* (2015.01)
*E05F 11/48* (2006.01)

(52) U.S. Cl.
CPC ..... *E05F 15/689* (2015.01); *E05F 11/48* (2013.01); *E05F 11/485* (2013.01); *E05F 11/486* (2013.01);
(Continued)

(58) Field of Classification Search
CPC ..... E05F 15/689; E05F 11/485; E05F 11/48; E05F 11/486; E05Y 2800/742; E05Y 2600/56; E05Y 2201/664; E05Y 2900/55
See application file for complete search history.

(56) References Cited

U.S. PATENT DOCUMENTS 4,970,911 A * 11/1990 Ujihara ..... E05F 11/486 74/501.5 R
2008/0005971 A1* 1/2008 Dickie ..... E05F 15/689 49/349

FOREIGN PATENT DOCUMENTS

JP 5-1590 Y2 1/1993
JP 8-93319 A 4/1996
(Continued)

OTHER PUBLICATIONS

*International Search Report (PCT/ISA/210) dated Jul. 19, 2016, by the Japanese Patent Office as the International Searching Authority for International Application No. PCT/JP2016/061887.
(Continued)

*Primary Examiner* — Jun S Yoo
(74) *Attorney, Agent, or Firm* — Buchanan Ingersoll & Rooney PC

(57) ABSTRACT

The method includes a step of fixing the other end of the drive wire to the drive drum; a step of temporarily placing one end of the drive wire in a temporary placement portion provided on the drum housing; and a step of applying tension to the drive wire by moving the one end of the drive wire to an engaging portion provided on the drive drum after canceling the placed state of the one end of the drive wire in
(Continued)

TENSION COMPLETION POSITION the temporary placement portion by pulling a portion of the drive wire on the one end side thereof by winding a portion of the drive wire on the other end side thereof by the drive drum with the one end of the drive wire placed in the temporary placement portion.

5 Claims, 13 Drawing Sheets

(52) U.S. Cl.
CPC ..... *E05Y 2201/664* (2013.01); *E05Y 2600/56* (2013.01); *E05Y 2800/742* (2013.01); *E05Y 2900/55* (2013.01)

(56) References Cited

FOREIGN PATENT DOCUMENTS

| | | |
|---|---|---|
| JP | 2009-185475 A | 8/2009 |
| JP | 2011-157703 A | 8/2011 |

OTHER PUBLICATIONS

Written Opinion (PCT/ISA/237) dated Jul. 19, 2016, by the Japanese Patent Office as the International Searching Authority for International Application No. PCT/JP2016/061887.

* cited by examiner

DRUM SET POSITION

END INSERTION POSITION

TENSION COMPLETION POSITION

WINDOW REGULATOR MANUFACTURING METHOD AND TENSION APPLYING METHOD FOR DRIVE WIRE

TECHNICAL FIELD

The present invention relates to a window regulator manufacturing method and a tension applying method for a drive wire.

BACKGROUND ART

For instance, a window regulator including: a guide rail which extends vertically; a slider base which is supported by the guide rail to be movable up and down and by which a window glass is supported; a drive wire which is routed into a loop and moves the slider base up and down; a drive drum around which the drive wire is wound; and a drum housing which supports the drive drum is known as a window regulator.

When this type of window regulator is produced (assembled), it is absolutely necessary to perform a step of placing tension on (applying tension to) the drive wire with all the components of the window regulator (that include the guide rail, the slider base, the drive wire, the drive drum and the drive housing in the above described example) assembled.

CITATION LIST

Patent Literature

Patent Literature 1: Japanese Unexamined Patent Publication H08-093319

SUMMARY OF THE INVENTION

Technical Problem

At conventional manufacturing sites (assembly sites), the step of placing tension on the drive wire is as follows. Specifically, in this step, tension is placed on the drive wire by pulling a wire end of the drive wire from a first portion (temporary wire installation place) to a second portion (wire engaging portion) of the drive drum by equipment, hand, etc., after winding the drive wire around the drive drum. This increases the number of manufacturing steps (assembling steps) and deteriorates efficiency, thus causing the occurrence of a loss of time (an increase of takt time).

This technical problem is common to not only a window regulator manufacturing method but also a tension applying method for the drive wire.

The present invention has been devised based on the above described issues, and it is an object of the present invention to achieve a window regulator manufacturing method and a tension applying method for a drive wire which enable, in a series of manufacturing steps, tension to be placed on (tension to be applied to) a drive wire with excellent efficiency.

Solution to Problem

A method of manufacturing a window regulator according to the present invention is provided, the window regular including a guide rail which extends vertically, a slider base which is supported by the guide rail to be movable up and down and by which a window glass is supported, a drive wire which is routed into a loop and moves the slider base up and down, a drive drum around which the drive wire is wound, and a drum housing which rotatably supports the drive drum; the method includes a step of fixing the other end of the drive wire to the drive drum; a step of temporarily placing one end of the drive wire in a temporary placement portion provided on the drum housing; and a step of applying tension to the drive wire by moving the one end of the drive wire to an engaging portion provided on the drive drum after canceling the placed state of the one end of the drive wire in the temporary placement portion by pulling a portion of the drive wire on the one end side thereof by winding a portion of the drive wire on the other end side thereof by the drive drum with the one end of the drive wire placed in the temporary placement portion.

The drive wire can consist of a pair of wires, wherein the slider base comprises a wire-end housing portion which houses ends of the pair of wires, and the method can further include a step of forming the drive wire, which is routed into the loop, by housing the ends of the pair of wires in the wire-end housing portion and connecting the ends of the pair of wires.

The one end of the drive wire can move from the temporary placement portion to the engaging portion upon the temporary placement portion and the engaging portion facing each other.

A step of supporting a motor unit is further provided for rotationally driving the drive drum on the drum housing and actuating the motor unit. The actuation of the motor unit can cause the one end of the drive wire to move from the temporary placement portion of the drum housing to the engaging portion of the drive drum to thereupon be engaged with the engaging portion of the drive drum.

The temporary placement portion can be formed at a peripheral edge of a drum housing portion of the drum housing, wherein the engaging portion of the drum housing is formed on an outer peripheral surface of the drive drum. Upon positions of the temporary engagement opening of the drum housing and the engaging portion of the drive drum in a circumferential direction coinciding with each other, the one end of the drive wire moves from the temporary placement portion of the drum housing to the engaging portion of the drive drum to thereupon be engaged with the engaging portion of drive drum.

The temporary placement portion of the drum housing and the engaging portion of the drive drum can be composed of openings which face each other in a plane orthogonal to a rotational shaft of the drive drum.

A tension applying method for a drive wire according to the present invention is provided, including a step of fixing the other end of said drive wire to said drive drum; a step of temporarily placing one end of said drive wire in a temporary placement portion provided on a fixed member facing said drive drum; and a step of applying tension to said drive wire by moving said one end of said drive wire to an engaging portion provided on said drive drum after canceling said temporarily placed state of said one end of said drive wire in said temporary placement portion by pulling a portion of said drive wire on said one end side thereof by winding a portion of said drive wire on said other end side thereof by said drive drum with said one end of said drive wire placed in said temporary placement portion.

Advantageous Effects of the Invention

According to the prevent invention, a window regulator manufacturing method and a tension applying method for a drive wire which enable, in a series of manufacturing steps, tension to be placed on (tension to be applied to) a drive wire with excellent efficiency are achieved.

DESCRIPTION OF EMBODIMENTS

<<Structure of Window Regulator 10>>

Figure 1:
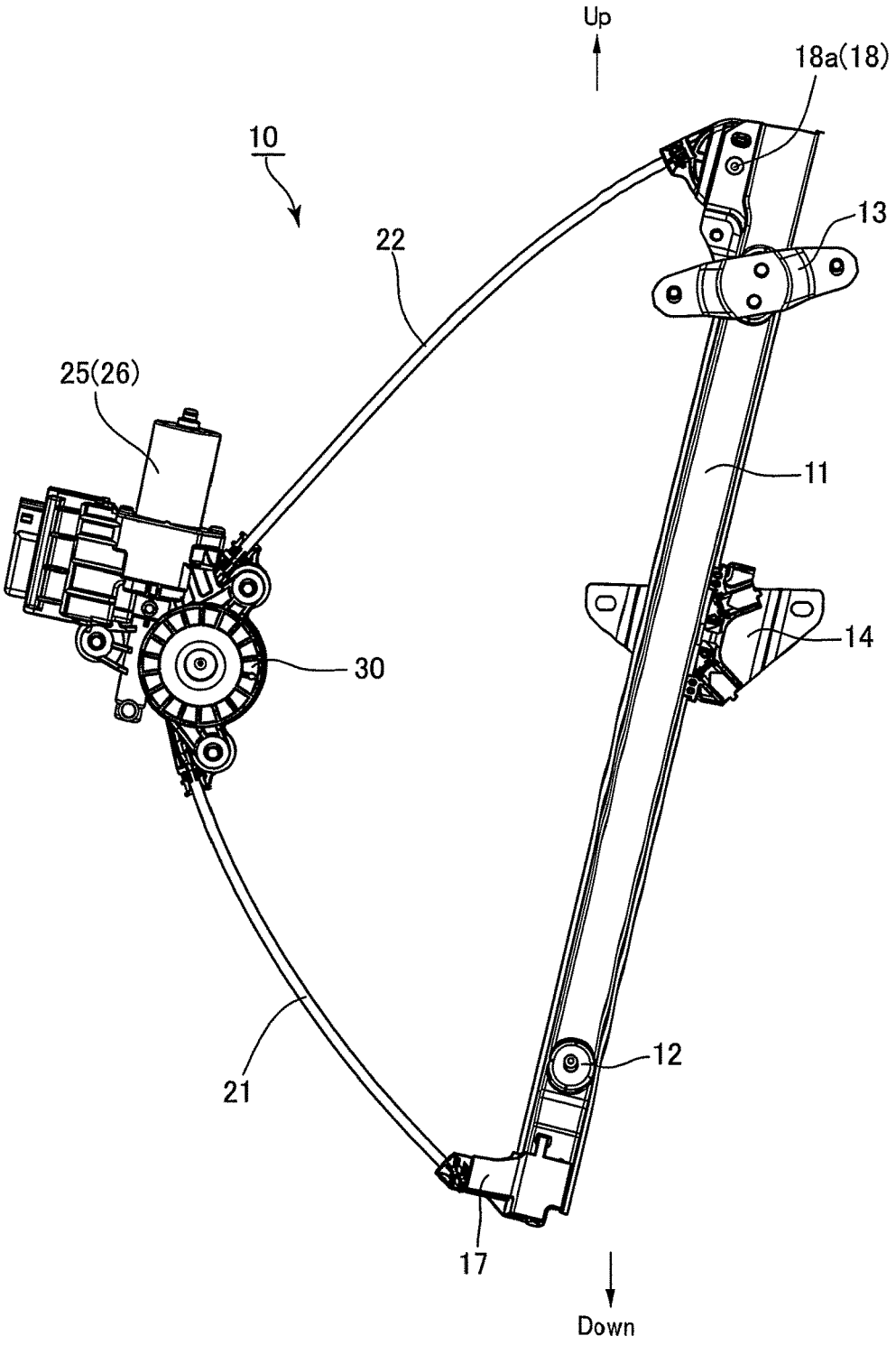
FIG. 1 is a front elevational view of a window regulator according to the present invention.
Figure 2:
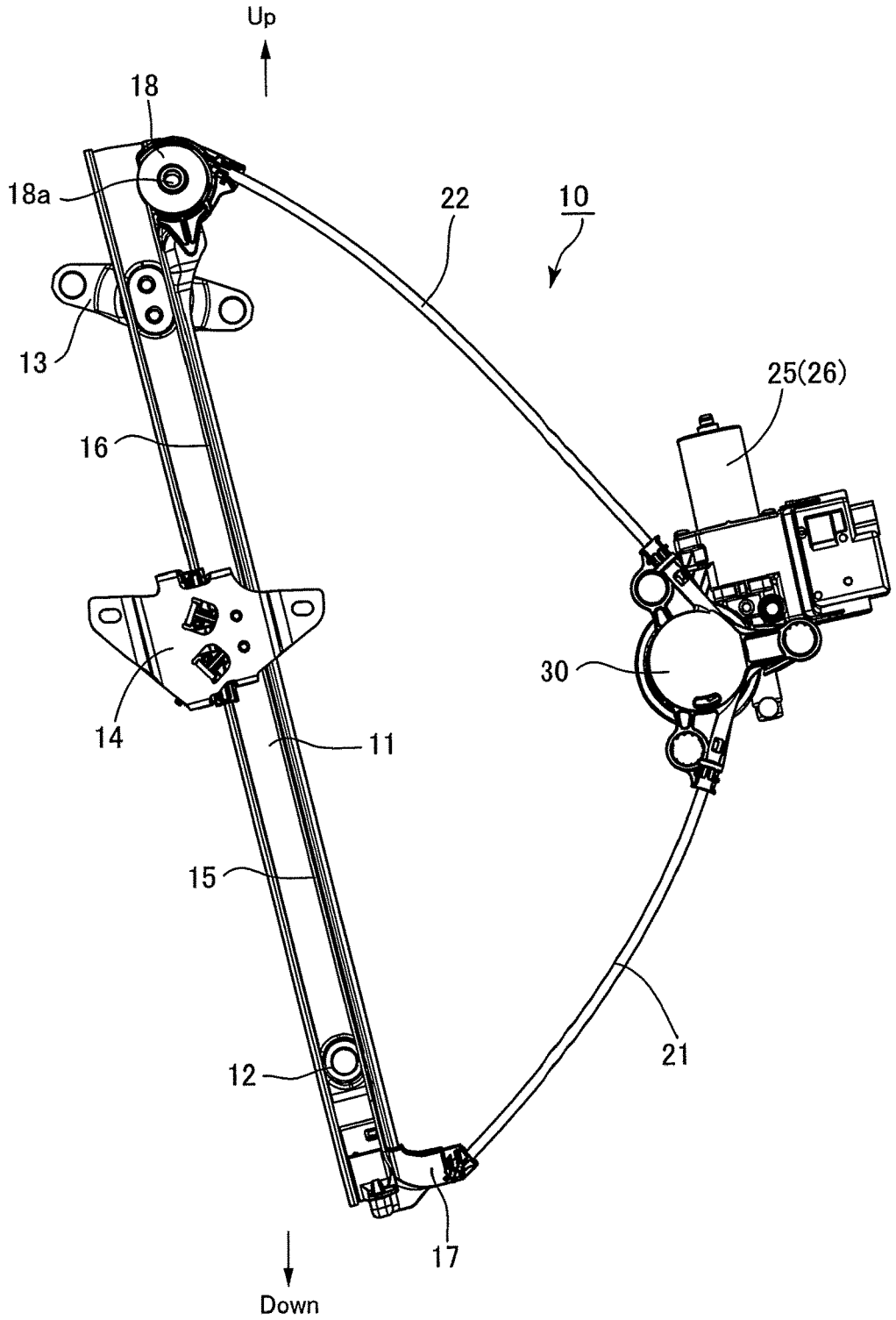
FIG. 2 is a rear elevational view of the window regulator according to the present invention.
Figure 3:
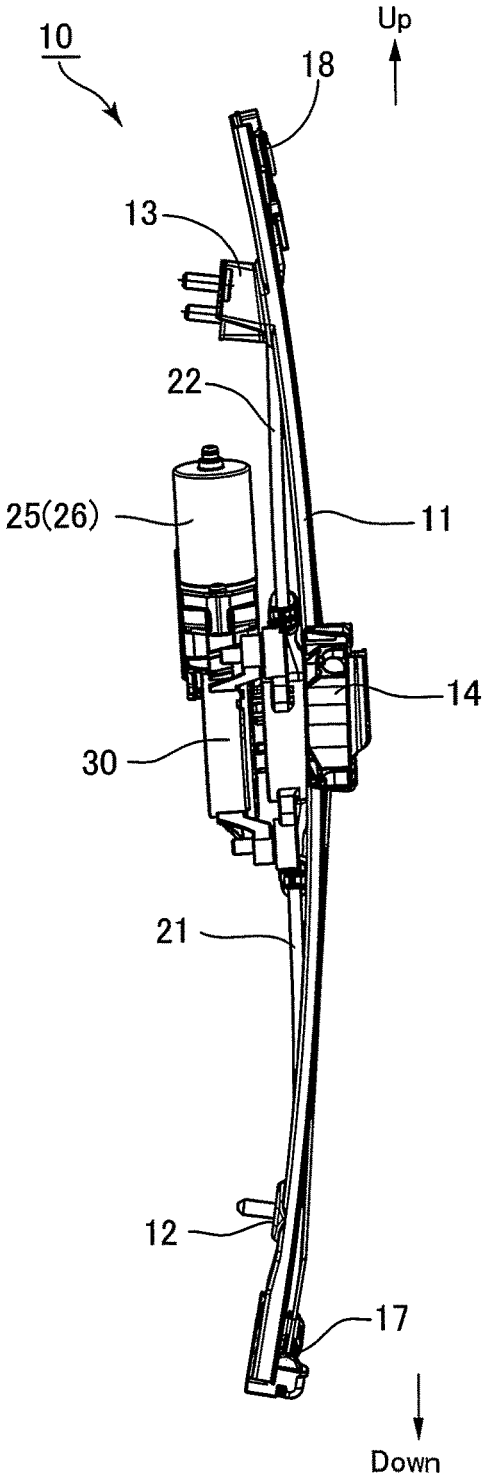
FIG. 3 is a side elevational view of the window regulator according to the present invention.

The structure of a window regulator 10 according to the present invention will be hereinafter discussed with reference to FIGS. 1 through 7. The window regulator 10 is installed in a door panel (not shown) of a vehicle and moves a window glass (not shown) up and down. "UP" and "DOWN" shown by arrows in FIGS. 1 and 3 correspond to the vehicle upward and downward directions.

The window regulator 10 is provided with a guide rail 11 that is made as a long member. The guide rail 11 is fixed to a door panel (inner panel) via brackets 12 and 13 provided at different positions in the longitudinal direction of the guide rail 11. A slider base 14 which supports a window glass is supported by the guide rail 11 to be movable in the longitudinal direction thereof.

The window regulator 10 is provided with a pair of drive wires: a drive wire (lower (lower dead point side) drive wire) 15 and a drive wire (upper (upper dead point side) drive wire) 16 that are for moving the slider base 14 up and down.

Figure 4:
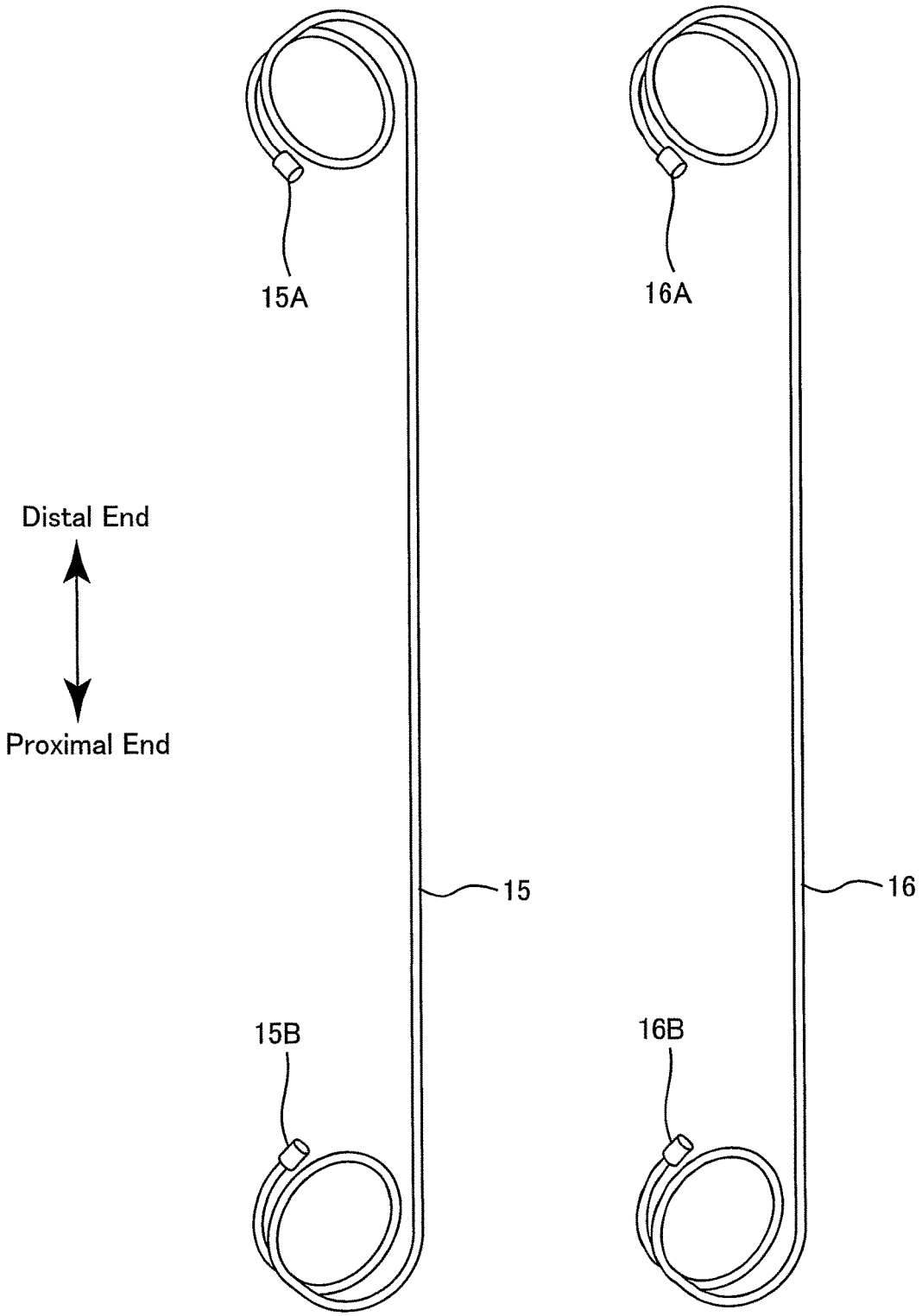
FIG. 4 is a diagram illustrating the configuration of a pair of drive wires.

As shown in FIG. 4, the drive wire 15 is provided at a distal end and a proximal end thereof with a columnar distal-end engaging head (one end of a drive wire) 15A and a columnar proximal-end engaging head 15B, respectively. The drive wire 16 is provided at a distal end and a proximal end thereof with a columnar distal-end engaging head (the other end of the drive wire) 16A and a columnar proximal-end engaging head 16B, respectively. The shape of the distal-end engaging head 15A and the proximal-end engaging head 15B of the drive wire 15 and the distal-end engaging head 16A and the proximal-end engaging head 16B of the drive wire 16 is not limited to a columnar shape and can be any other shape such as a spherical shape.

The slider base 14 is provided with a "wire-end housing portion" to which the proximal-end engaging head 15B of the drive wire 15 and the proximal-end engaging head 16B of the drive wire 16 are mounted. This "wire-end housing portion" can be configured of, e.g., a "wire-grooved engaging portion" which includes a "wire groove" allowing the drive wire 15 and the drive wire 16 to pass through and an "engaging portion" which is engaged with the proximal-end engaging head 15B and the proximal-end engaging head 16B without the proximal-end engaging head 15B and the proximal-end engaging head 16B passing through. This "wire-grooved engaging portion" can include a "spring" which absorbs tension acting on the drive wire 15 and the drive wire 16.

A "drive wire which is routed into a loop" is configured by mounting the proximal-end engaging head 15B of the drive wire 15 and the proximal-end engaging head 16B of the drive wire 16 to the "wire-end housing portion" of the slider base 14.

The drive wire 15 extends downward along the guide rail 11 from the slider base 14 and is guided by a guide piece (wire guide member) 17 provided in the vicinity of the lower end of the guide rail 11. The guide piece 17 is fixed to the guide rail 11, and the drive wire 15 is supported to be capable of advancing and retreating along a wire guide groove formed on the guide piece 17.

The drive wire 16 extends upward along the guide rail 11 from the slider base 14 and is guided by a guide pulley (wire guide member) 18 provided in the vicinity of the upper end of the guide rail 11. The guide pulley 18 is rotatable about a rotational shaft 18*a* and supported via a wire guide groove formed on the outer periphery of the guide pulley 18.

The drive wire 15 and the drive wire 16 that extend from the guide piece 17 and the guide pulley 18 are inserted into a guide tube 21 and a guide tube 22, respectively, and wound around a drive drum 40 (FIGS. 7A, 7B and 7C) provided inside a drum housing (stationary member/fixed member) 30 to which the guide tube 21 and the guide tube 22 are connected.

The drum housing 30 is fixed to the door panel (inner panel). A motor unit 26 that includes a motor 25 for rotationally driving the drive drum 40 is supported on the drum housing 30. Rotationally driving the drive drum 40 forward and reverse by the motor 25 (the motor unit 26) causes one of the drive wire 15 and the drive wire 16 to increase the winding amount thereof around the drive drum 40 and causes the other of the drive wire 15 and the drive wire 16 to advance from the drive drum 40, thereby causing the slider base 14 to move along the guide rail 11 due to the pulling-loosening relationship between the drive wire 15 and the drive wire 16. In accordance with this movement of the slider base 14, the window glass moves up and down.

Figure 5:
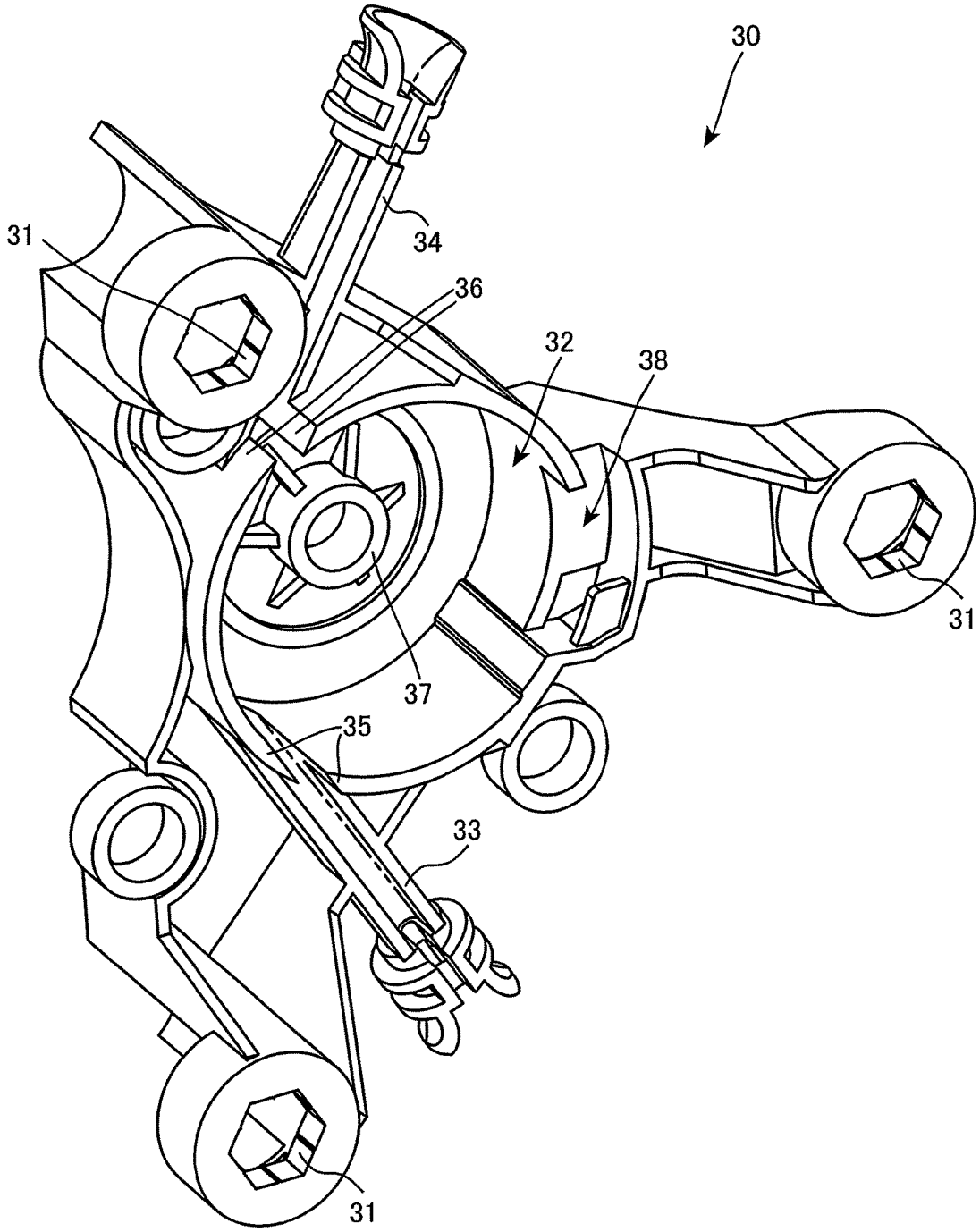
FIG. 5 is a perspective view illustrating the unitary structure of a drum housing.
Figure 6:
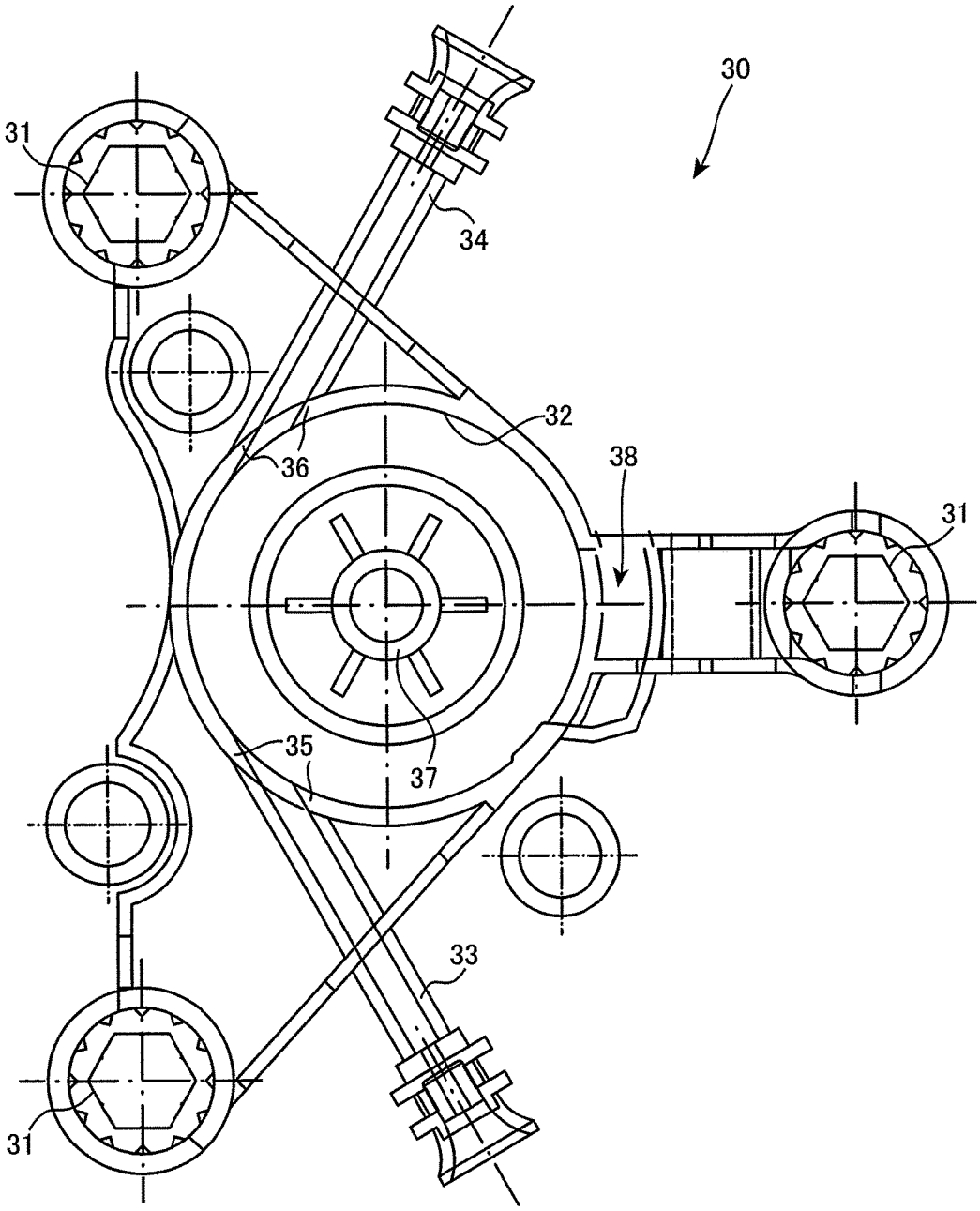
FIG. 6 is a plan view illustrating the unitary structure of the drum housing.

FIGS. 5 and 6 show the unitary structure of the drum housing 30. The drum housing 30 is provided with three fastening-bolt insertion holes 31 which are arranged as if on the vertices of a substantially regular triangle, and the drum housing 30 is fixed to the door panel (inner panel) by three fastening bolts (not shown) which are inserted into the three fastening-bolt insertion holes 31.

Figure 7A:
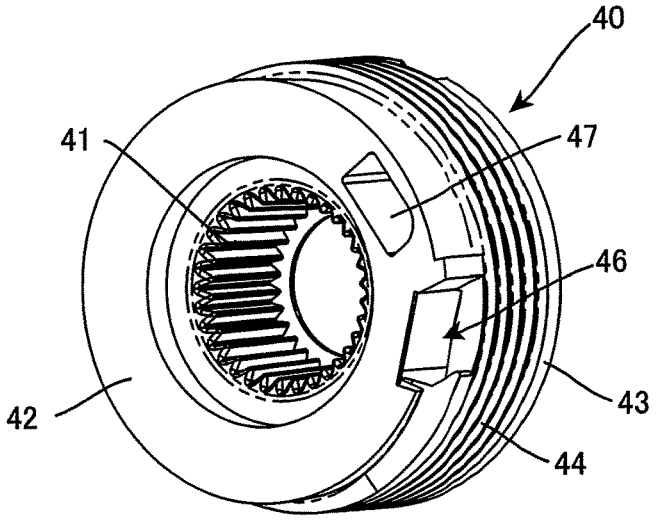
FIG. 7A is a perspective view illustrating the unitary structure of a drive drum.
Figure 7B:
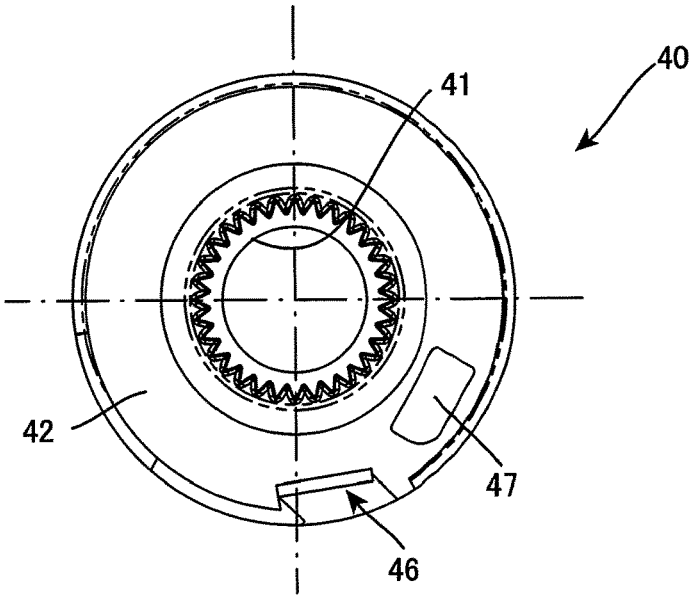
FIG. 7B is a plan view illustrating the unitary structure of the drive drum.
Figure 7C:
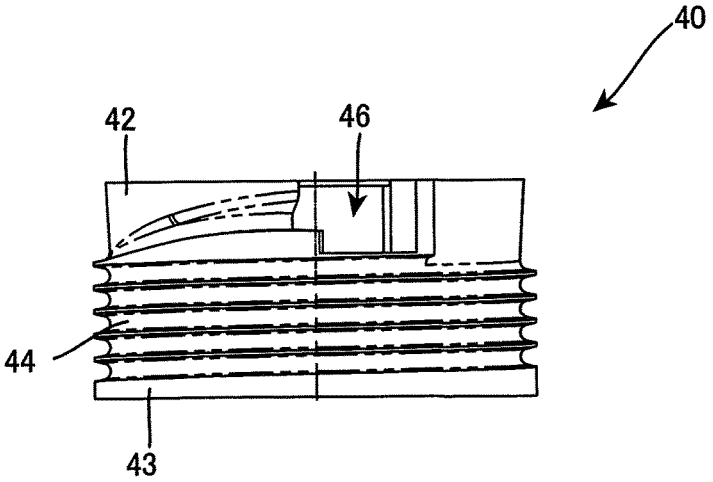
FIG. 7C is a side elevational view illustrating the unitary structure of the drive drum.

The drum housing 30 is provided with a drum housing portion 32 in the shape of a bottomed cylinder which houses the drive drum 40 (FIGS. 7A, 7B and 7C). The drum housing 30 is provided with a drive wire lead-in portion 33 for leading the drive wire 15 to the drum housing portion 32 and a drive wire lead-in portion 34 for leading the drive wire 16 to the drum housing portion 32. Sag-prevention ribs 35 for preventing the drive wire 15 from sagging are formed at the joined portion (boundary) between the drum housing portion 32 and the drive wire lead-in portion 33. Sag-prevention ribs 36 for preventing the drive wire 16 from sagging are formed at the joined portion (boundary) between the drum housing portion 32 and the drive wire lead-in portion 34. A strength rib 37 for improving the strength of the drum housing 30 and the drive drum 40 that is supported by the drum housing 30 is formed at the bottom center of the drum housing portion 32.

The drum housing 30 is provided at a peripheral edge of the drum housing portion 32 with a temporary engagement opening (temporary placement opening/temporary engagement portion/temporary placement portion/placement portion) 38 which allows the distal-end engaging head 15A of the drive wire 15 which has been led to the drum housing portion 32 via the drive wire lead-in portion 33 and the sag-prevention ribs 35 to be temporarily engaged with (to be temporarily placed in/to be placed in).

The wall portion which surrounds the temporary engagement opening 38 is partly cut out (to be provided with a hole) to allow wire ends of the drive wires to pass through. This makes it possible to improve the ease of mounting of wire ends of the drive wires to the temporary engagement opening 38. Routing the drive wires through the aforementioned cut-out portion (hole) so that the wire ends of the drive wires come out of the drum housing 30 and winding the drive wires by the drive drum 40 cause the wire ends of the drive wires to move to the temporary engagement opening 38.

FIGS. 7A, 7B and 7C show the unitary structure of the drive drum 40. The drive drum 40 is a doughnut-shaped member which is housed in the drum housing portion 32 of the drum housing 30. In a state where the drive drum 40 is housed in the drum housing portion 32 of the drum housing 30, the strength rib 37 of the drum housing 30 is inserted into a rotational shaft hole 41 of the rotational drum 40.

The drive drum 40 is provided with a top plate portion 42, a bottom plate portion 43 and a wire winding groove (wire winding portion) 44 positioned on the outer peripheral surface between the top plate portion 42 and the bottom plate portion 43. The drive wire 15 and the drive wire 16 are wound in the wire winding groove 44.

Figure 8:
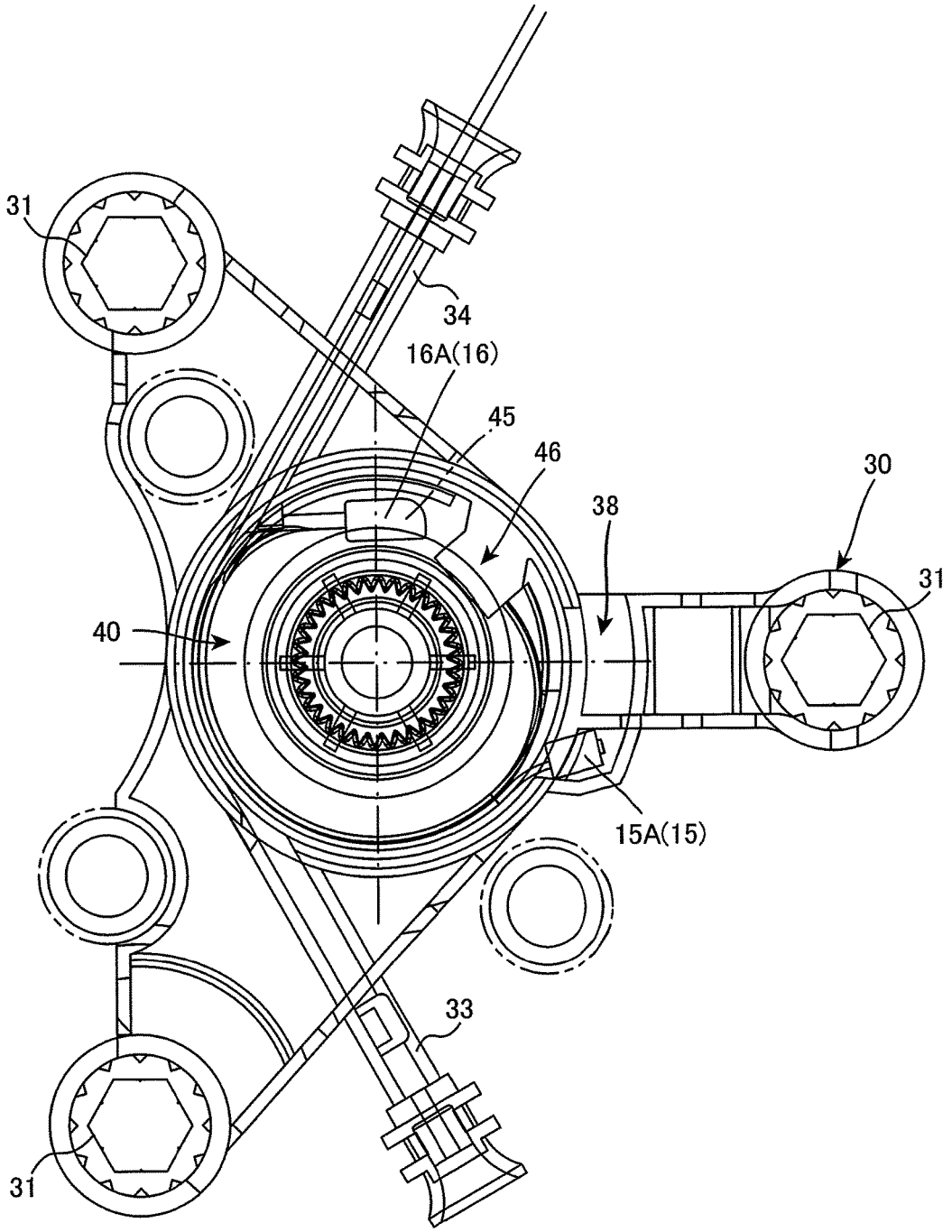
FIG. 8 is a first diagram illustrating a window regulator manufacturing method (assembling method) according to the present invention.
Figure 9:
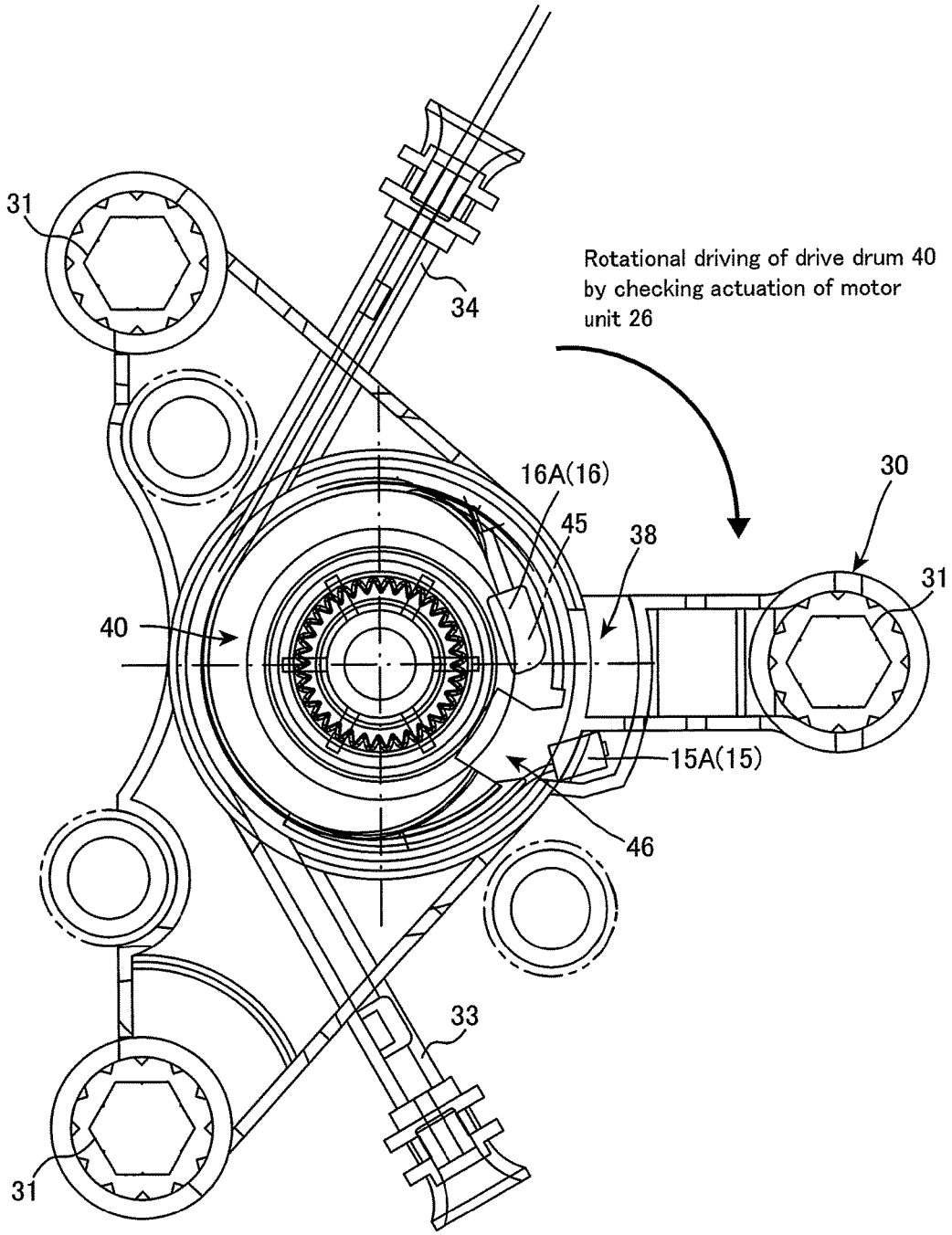
FIG. 9 is a second diagram illustrating the window regulator manufacturing method (assembling method) according to the present invention.
Figure 10:
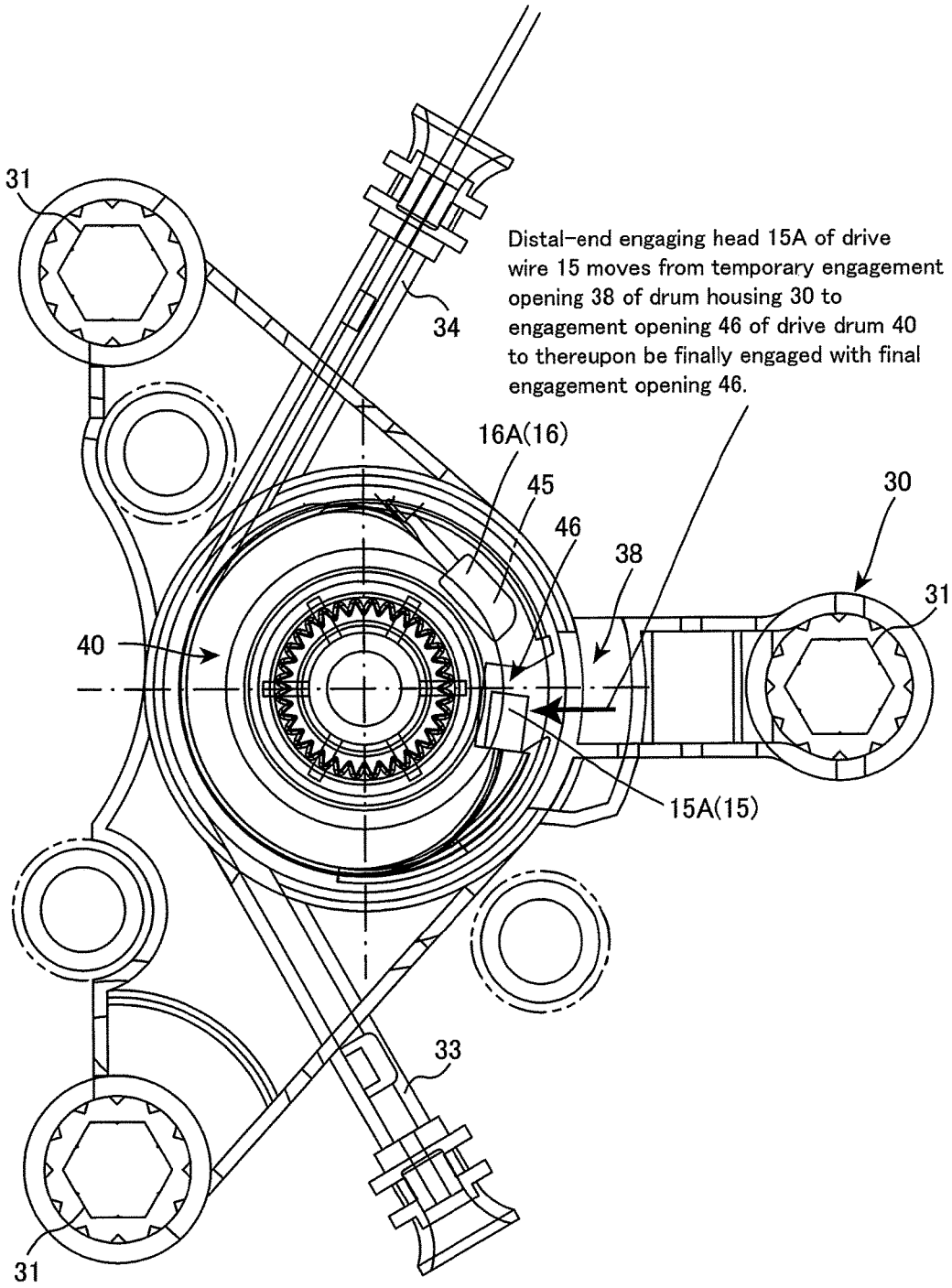
FIG. 10 is a third diagram illustrating the window regulator manufacturing method (assembling method) according to the present invention.

The drive drum 40 is provided, at a position adjacent to (continuous with) the end of the wire winding groove 44 on the bottom plate portion 43 side, with an engagement opening 45 for allowing the distal-end engaging head 16A of the drive wire 16 to be engaged with (FIGS. 8 through 10).

The drive drum 40 is provided, at a position adjacent to (continuous with) the end of the wire winding groove 44 on the top plate portion 42 side, with a final engagement opening (engagement opening/final engagement portion/engagement portion) 46 for allowing the distal-end engaging head 15A of the drive wire 15 to be finally engaged with (to be engaged with).

In a state where the drive drum 40 is housed in the drum housing portion 32 of the drum housing 30, the temporary engagement opening 38 of the drum housing 30 and the final engagement opening 46 of the drive drum 40 face each other (stand face-to-face with each other) in a plane orthogonal to the rotational shaft hole 41 of the drive drum 40.

The drive drum 40 is provided with a through-hole 47 in the shape of a substantially rectangle in a plan view which is formed through the top plate portion 42 and the bottom plate portion 43. The through-hole 47 is a through-hole for the formation of the engagement opening 45 (FIGS. 8 through 10) of the drive drum 40.

<<Method of Manufacturing (Assembling) the Window Regulator 10>>

A method of manufacturing (assembling) the window regulator 10 according to the present invention will be hereinafter discussed with reference to FIGS. 8 through 10. The window regulator 10 which will be discussed hereinafter is that in a subassembly state before incorporated in a vehicle door.

First, the components of the window regulator 10 except the drive wires 15 and 16 (the drive wire which is routed into a loop) and the motor unit 26 (i.e., the guide rail 11, the brackets 12 and 13, the slider base 14, the guide piece 17, the guide pulley 18, the guide tubes 21 and 22, the drum housing 30 and the drive drum 40) are assembled.

This component assembly process is as follows. The brackets 12 and 13 are mounted to the guide rail 11. The slider base 14 is mounted to the guide rail 11. The guide piece 17 and the guide pulley 18 are mounted to the guide rail 11. The drive drum 40 is housed in the drum housing 30.

At this moment, the temporary engagement opening (temporary engagement portion) 38, which is for allowing the distal-end engaging head 15A of the drive wire 15 to be temporarily engaged with (to be temporarily placed in/to be placed in), is formed in the drum housing 30, which does not operate with rotational driving of the drive drum 40. In addition, the final engagement opening (final engagement portion) 46, which is for allowing the distal-end engaging head 15A of the drive wire 15 to be finally engaged with, is formed in the drive drum 40. The order in which the temporary engagement opening 38 and the final engagement opening 46 described herein are formed is flexible.

Subsequently, the proximal-end engaging head 15B of the drive wire 15 and the proximal-end engaging head 16B of the drive wire 16 are each mounted to the "wire-end housing portion" of the slider base 14. This forms the "drive wire which is routed into a loop."

Subsequently, after being guided upward along the guide rail 11, the drive wire 16 is folded back at the guide pulley 18 to be inserted into the guide tube 22 to reach the inside of the drum housing portion 32 of the drum housing 30. Thereafter, the distal-end engaging head 16A of the drive wire 16 is brought into engagement with the engagement opening 45 of the drive drum 40.

Subsequently, after being guided downward along the guide rail 11, the drive wire 15 is folded back at the guide piece 17 to be inserted into the guide tube 21 to reach the inside of the drum housing portion 32 of the drum housing 30. Thereafter, the distal-end engaging head 15A of the drive wire 15 is brought into temporary engagement with (to be temporarily placed/placed at) the temporary engagement opening 38 of the drum housing 30. FIG. 8 shows this state as a "drum set position."

Subsequently, the drive drum 40 is driven to rotate clockwise as viewed in FIG. 8 from the drum set position shown in FIG. 8 by checking the actuation of the motor unit 26 with the motor unit 26, which is for rotationally driving the drive drum 40, supported on the drum housing 30. Thereupon, the drive wire 15 and the drive wire 16 are wound in the wire winding groove 44 to be tensioned. As the drive wire 15 and the drive wire 16 are wound in the wire winding groove 44 by advancement of the rotational driving of the drive drum 40, the tension placed on the drive wire 15 and the drive wire 16 increases. FIG. 9 shows this state as an "end insertion position."

In a short time, the tension placed on the drive wire 15 and the drive wire 16 exceeds a predetermined value, and the positions of the temporary engagement opening 38 of the drum housing 30 and the final engagement opening 46 of the drive drum 40 in the circumferential direction coincide with each other (the temporary engagement opening 38 and the final engagement opening 46 face each other). Thereupon, the distal-end engaging head 15A of the drive wire 15 moves from the temporary engagement opening 38 of the drum housing 30 to the final engagement opening 46 of the drive drum 40 to thereupon be finally engaged with the final engagement opening 46 of the drive drum 40. FIG. 10 shows this state as a "tension completion position."

Operations during the transition from the "end insertion position" of FIG. 9 to the "tension completion position" of FIG. 10 will be discussed in detail hereinafter. Winding a portion of the drive wire 16 on the distal end (the other end of the drive wire) side thereof by the drive drum 40 causes a portion of the drive wire 15 on the distal end (one end of the drive wire) side thereof to be pulled. The winding of the portion of the drive wire 16 on the distal end (the other end of the drive wire) side thereof causes the proximal end of the drive wire 16 to come into contact with the slider base 14, thereby causing the "spring" of the "wire-end housing portion" (paragraph 0022) of the slider base 14 to be compressed. This compression of the "spring" causes the slider base 14 to move down, thereby causing the portion of the drive wire 15 on the distal end (the one end of the drive wire) side thereof to be pulled. At this time, the portion of the drive wire 15 on the distal end (the one end of the drive wire) side thereof is fixed at one end thereof to the drum housing 30 at the temporary engagement opening 38. Upon the positions of the temporary engagement opening 38 of the drum housing 30 and the final engagement opening 46 of the drive drum 40 in the circumferential direction coinciding with each other (upon the temporary engagement opening 38 and the final engagement opening 46 facing each other), the distal end of the drive wire 15 (the one end of the drive wire) moves to the final engagement opening 46 to be tensioned (to be given tension).

At this stage, the temporary engagement opening 38 of the drum housing 30 and the final engagement opening 46 of the drive drum 40 face each other in a plane orthogonal to the rotational shaft hole 41 of the drive drum 40, and the final engagement opening 46 of the drive drum 40 is provided adjacent to (continuous with) the wire winding groove 44 on the outer peripheral surface of the drive drum 40. Accordingly, the distal-end engaging head 15A of the drive wire 15 can be smoothly moved from the temporary engagement opening 38 of the drum housing 30 to the final engagement opening 46 of the drive drum 40. In addition, the motor unit 26, which is supported immediately above the drum housing 40, does not interfere with movement of the distal-end engaging head 15A of the drive wire 15.

According to the above described method of manufacturing the window regulator 10, the operator only has to temporarily engage the distal-end engaging head 15A of the drive wire 15 with (temporarily place the distal-end engaging head 15A of the drive wire 15 at/place the distal-end engaging head 15A of the drive wire 15 at) the temporary engagement opening 38 of the drum housing 30, and thereafter, tension can be placed on the drive wire 15 (further on the drive wire 16) simply by checking the actuation of the motor unit 26. Namely, tension can be placed on the drive wire 15 and the drive wire 16 with excellent efficiency in a series of manufacturing steps.

In conventional manufacturing sites, a motor unit for rotationally driving a drive drum is required to be supported on a drum housing at a timing after tension is placed on drive wires. The reason for this is that the motor unit is supported on the drum housing in such a manner as to close the drive drum and the drive wires (the joined portion therebetween). However, if the motor unit is supported on the drum housing with tension placed on the drive wires, there is a possibility of a part(s) (specifically a guide rail) of the window regulator being subjected to a large force in a bending direction and thereupon buckling. In this regard, according to the method of manufacturing the present embodiment of the window regulator 10, a part(s) (specifically the guide rail 11) of the window regulator 10 can be prevented from being subjected to a large force in a bending direction and thereupon buckling because no tension is placed on the drive wires 15 and 16 at the stage of supporting the motor unit 26 on the drum housing 30.

Figure 11:
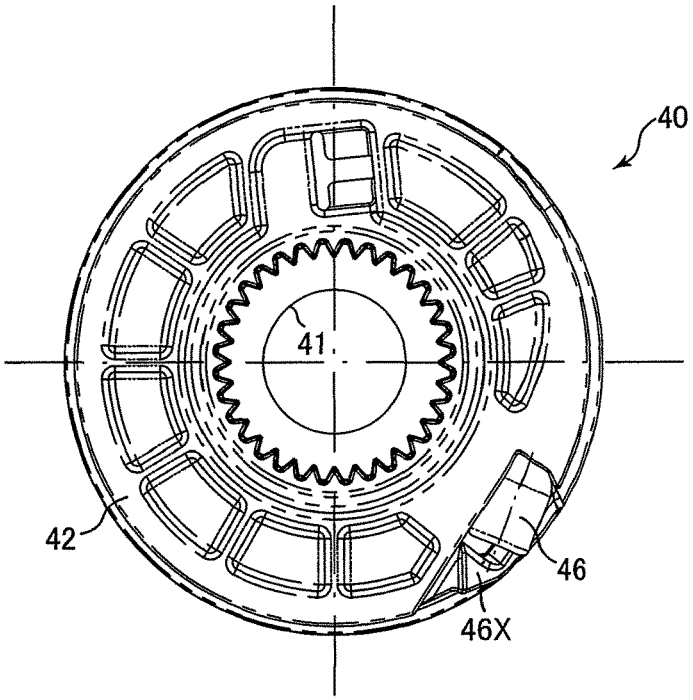
FIG. 11 is a plan view illustrating the unitary structure of the drive drum according to another embodiment of the present invention.
Figure 12:
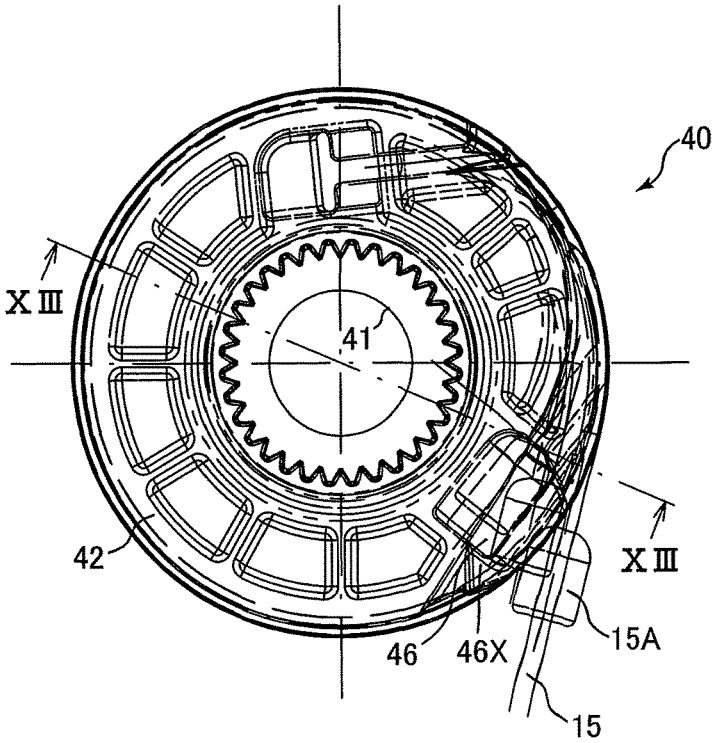
FIG. 12 is a plan view illustrating a state where the distal-end engaging head of a drive wire is inserted and engaged in a final engagement opening in which a retaining guide wall of the drive drum shown in FIG. 11 is formed.
Figure 13:
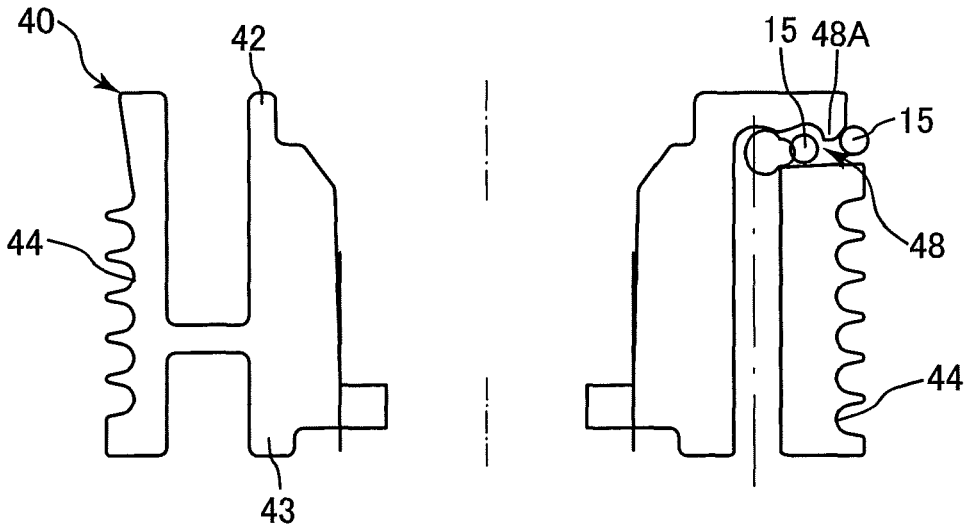
FIG. 13 is a sectional view taken along the line XIII-XIII shown in FIG. 12.

FIGS. 11 through 13 show another embodiment of the present invention. In this another embodiment, a retaining guide wall 46X is projected to be positioned inside the final engagement opening 46 of the drive drum 40 as shown in FIGS. 11 and 12. In addition, as shown in FIG. 12, the distal-end engaging head 15A of the drive wire 15 is formed into such a flat shape as to engage with that engaging space with a minimal clearance which is surrounded by the inner wall of the final engagement opening 46 and the retaining guide wall 46X of the drive drum 40.

When the distal-end engaging head 15A of the drive wire 15 is brought into temporary engagement with (is temporarily placed/placed at) the temporary engagement opening 38 of the drum housing 30, the retaining guide wall 46X does not interfere with this temporary engagement (temporary placement/placement). In addition, the retaining guide wall 46X makes it possible for the distal-end engaging head 15A of the drive wire 15 to be wound around the drive drum 40 along the wire winding groove 44 with high precision (abnormal winding such as layer-skip winding can be prevented from occurring). Additionally, in a state where the distal-end engaging head 15A of the drive wire 15 is finally engaged with the final engagement opening 46 of the drive drum 40, the distal-end engaging head 15A of the drive wire 15 abuts against the retaining guide wall 46X, which makes it possible to achieve a high retaining effect.

As shown in FIG. 13, in order to make the outer diameter of a wire entrance 48 provided in the drive drum 40 equal to or slightly smaller than the outer diameter of the drive wire 15, a folded portion 48A that is folded in the direction of counterforce to the drive wire 15 is provided in the vicinity of the wire entrance 48. This makes it possible to achieve the effect of retaining the drive wire 15 inserted into the wire entrance 48.

Figure 14:
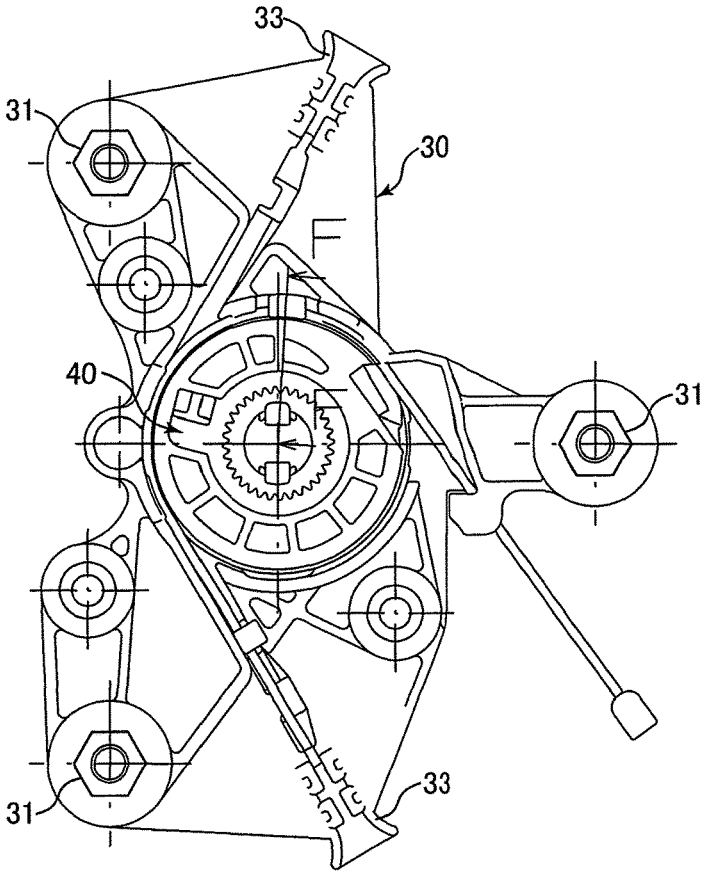
FIG. 14 is a plan view illustrating a window regulator according to yet another embodiment of the present invention.
Figure 15:
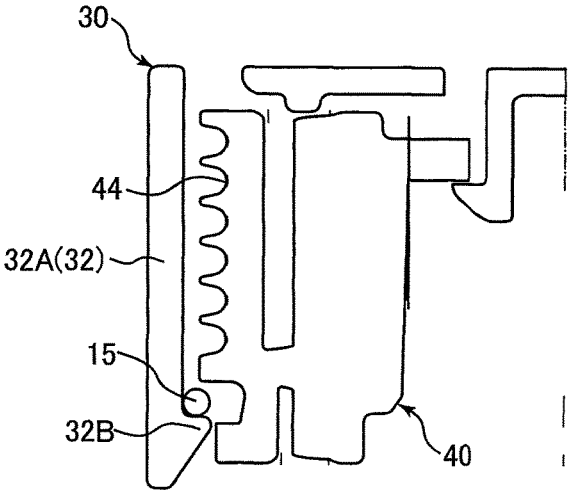
FIG. 15 is a sectional view taken along the line XV-XV shown in FIG. 14.

FIGS. 14 and 15 show yet another embodiment of the present invention. In this embodiment, the drum housing 30 is provided on a side wall 32A of the drum housing portion 32 with an engaging claw 32B capable of hooking the drive wire 15 when the drive wire 15 is routed. This makes it possible to prevent the drive wire 15 from slipping out during the time before the motor unit 26 is fixed to the drum housing 30. In addition, even when the operation to invert the top and bottom of a combination (temporarily-combined body) of the drum housing 30 and the drive drum 40 is performed, the drive wire 15 can be prevented from slipping out, which prevents the drive drum 40 from being disengaged from the drum housing 30, thus making it possible to hold both the drive drum 40 and the drum housing 30 with reliability.

The above embodiment has been described by illustrating the case where the distal-end engaging head 15A of the drive wire 15 is led to the final engagement opening 46 of the drive drum 40 after being temporarily immobilized by being temporarily engaged with the temporary engagement opening 38 of the drum housing 30. However, an embodiment in which the distal-end engaging head 15A of the drive wire 15 is led to the final engagement opening 46 of the drive drum 40 in such a manner as to be passed through the temporary engagement opening 38 of the drum housing 30 (this is referred to as temporary placement/placement) is also possible. In this regard, the terms "temporary placement" and "placement" are used as technical terms (wording) that include the concept of the term "temporary engagement" and are broader in concept than the term "temporary engagement."

The above embodiment has been described by illustrating the case where the temporary engagement opening 38 of the drum housing 30, with which the distal-end engaging head 15A of the drive wire 15 is temporarily engaged, is formed in the drum housing 30 that supports the drive drum 40. However, it is possible to form the temporary engagement opening (temporary engagement portion) in a stationary member (fixed member) other than the drum housing 30 if only the stationary member (fixed member) does not operate with rotational driving of the drive drum 40 and faces the drive drum 40. The stationary member (fixed member) can be made into, e.g., a gear housing of a motor, etc.

The above embodiment has been described by illustrating the case where the slider base 14 is provided with the "wire-end housing portion," to which the proximal-end engaging head 15B of the drive wire 15 and the proximal-end engaging head 16B of the drive wire 16 are mounted. However, the "wire-end housing portion" can be provided on a component other than the slider base 14 so long as this component is associated with upward and downward movements of the slider base 14.

The above embodiment has been described by illustrating the case where the drive drum 40 is provided on the outer peripheral surface thereof with the final engagement opening 46. However, the drive drum 40 can be provided in the upper end surface thereof with the final engagement opening as long as the final engagement opening is not subject to restrictions on the layout of the motor unit 26 that is positioned immediately above the drive drum 40.

The above embodiment has been described by illustrating the case where, at the time of manufacturing (assembling) a window regulator with a motor unit, a drive drum is driven to rotate to place tension on a pair of drive wires by checking the actuation of the motor unit. However, in the case of a window regulator subassembly including no motor unit, it is possible to place tension on the pair of drive wires by rotational driving of the drive drum using a special jig.

Although the pair of drive wires 15 and 16 are connected to form the "drive wire which is routed into a loop" in the above described embodiment, the "drive wire which is routed into a loop" can also be made into a single component.

The above embodiment has been described by illustrating the case where the present invention is applied to a "window regulator manufacturing method." However, the present invention can also be applied to other methods such as a "tension applying method for a drive wire."

INDUSTRIAL APPLICABILITY

A window regulator manufacturing method and a tension applying method for a drive wire according to the present invention are suitable for application in, e.g., a vehicle window regulator manufacturing method and a tension applying method for a drive wire of a vehicle.

REFERENCE SIGNS LIST

10 Window regulator
11 Guide rail
12 13 bracket
14 Slider base (Wire-end housing portion)
15 Drive wire (Drive wire on lower side (lower dead point side))
15A Distal-end engaging head (one end of a drive wire)
15B Proximal-end engaging head
16 Drive wire (Drive wire on upper side (upper dead point side))
16A Distal-end engaging head (the other end of the drive wire)
16B Proximal-end engaging head
17 Guide piece (Wire guide member)
18 Guide pulley (Wire guide member)
18*a* Rotational shaft
21 22 Guide tube
25 Motor
26 Motor unit
30 Drum housing (Stationary member)
31 Fastening-bolt insertion hole
32 Drum housing portion
32A Side wall
32B Engaging claw
33 34 Drive wire lead-in portion
35 36 Sag-prevention rib
37 Strength rib
38 Temporary engagement opening (Temporary placement opening/Temporary engagement portion/Temporary placement portion/Placement portion)
40 Drive drum
41 Rotational shaft hole
42 Top plate portion
43 Bottom plate portion
44 Wire winding groove (Wire winding portion)
45 Engagement opening
46 Final engagement opening (Engagement opening/Final engagement portion/Engagement portion)
46X Retaining guide wall
47 Through-hole
48 Wire entrance
48A Folded portion

The invention claimed is:

1. A method of manufacturing a window regulator including: a guide rail which extends vertically; a slider base which is supported by said guide rail to be movable up and down and by which a window glass is supported; a drive wire which is routed into a loop and moves said slider base up and down; a drive drum around which said drive wire is wound; and a drum housing which rotatably supports said drive drum, wherein said method comprises:

a step of fixing the other end of said drive wire to said drive drum;

a step of temporarily placing one end of said drive wire in a temporary placement portion provided on said drum housing; and a step of applying tension to said drive wire by moving said one end of said drive wire to an engaging portion provided on said drive drum after canceling said placed state of said one end of said drive wire in said temporary placement portion by pulling a portion of said drive wire on said one end side thereof by winding a portion of said drive wire on said other end side thereof by said drive drum with said one end of said drive wire placed in said temporary placement portion, wherein said temporary placement portion is formed at a peripheral edge of a drum housing portion of said drum housing, wherein said engaging portion of said drive drum is formed on an outer peripheral surface of said drive drum, and wherein, upon positions of said temporary placement portion of said drum housing and said engaging portion of said drive drum in a circumferential direction coinciding with each other, said one end of said drive wire moves from said temporary placement portion of said drum housing to said engaging portion of said drive drum to thereupon be engaged with said engaging portion of said drive drum.

2. The method of manufacturing said window regulator according to claim 1, wherein said drive wire consists of a pair of wires, wherein said slider base comprises a wire-end housing portion which houses ends of said pair of wires, and wherein said method further comprises a step of forming said drive wire, which is routed into said loop, by housing said ends of said pair of wires in said wire-end housing portion and connecting said ends of said pair of wires.

3. The method of manufacturing said window regulator according to claim 1, wherein said one end of said drive wire moves from said temporary placement portion to said engaging portion upon said temporary placement portion and said engaging portion facing each other.

4. The method of manufacturing said window regulator according to claim 1, further comprising a step of supporting a motor unit for rotationally driving said drive drum on said drum housing and actuating said motor unit, wherein said actuation of said motor unit causes said one end of said drive wire to move from said temporary placement portion of said drum housing to said engaging portion of said drive drum to thereupon be engaged with said engaging portion of said drive drum.

5. The method of manufacturing said window regulator according to claim 1, wherein said temporary placement portion of said drum housing and said engaging portion of said drive drum are composed of openings which face each other in a plane orthogonal to a rotational shaft of said drive drum.

* * * * *